US006976923B1

(12) United States Patent
Clarke et al.

(10) Patent No.: US 6,976,923 B1
(45) Date of Patent: Dec. 20, 2005

(54) CAROUSEL DEVICES

(76) Inventors: William A Clarke, 4549 Budd Dr., Erie, PA (US) 16506; Pamela J. Clarke, 4549 Budd Dr., Erie, PA (US) 16506

( * ) Notice: Subject to any disclaimer, the term of this patent is extended or adjusted under 35 U.S.C. 154(b) by 116 days.

(21) Appl. No.: 10/974,600

(22) Filed: Oct. 27, 2004

Related U.S. Application Data

(62) Division of application No. 10/863,049, filed on Jun. 7, 2004, now Pat. No. 6,869,368.

(51) Int. Cl.[7] ..... A63G 1/12
(52) U.S. Cl. ..... 472/19; 472/21
(58) Field of Search ..... 472/14, 20–24, 472/25, 26; 482/57; 104/74, 75

(56) References Cited

U.S. PATENT DOCUMENTS 1,866,490 A * 7/1932 Scharf ..... 472/24
3,203,695 A * 8/1965 Parker ..... 472/22
3,417,990 A * 12/1968 Marasco ..... 472/5
3,467,373 A * 9/1969 Justice ..... 472/22
4,848,736 A * 7/1989 Anderson ..... 472/22
5,074,820 A * 12/1991 Nakayama ..... 446/29
5,607,359 A * 3/1997 Farmer, Sr. ..... 472/21
5,954,588 A * 9/1999 Lien ..... 472/21

* cited by examiner

*Primary Examiner*—Kien Nguyen
(74) *Attorney, Agent, or Firm*—Richard K. Thomson

(57) ABSTRACT

A first embodiment of carousel device provides a bouncer which cannot be tipped over accidentally. Further, a oscillating circuit enables a battery-operated motor to gently oscillate the bouncer through an 80° arc. A pair of retractable rockers are provided on the bottom of the stationary base to afford the baby additional motion while bouncing. A second embodiment provides a straddlable vehicle which a youngster can peddle, a sound circuit being activated by the pedaling as inducement to continue exercising.

11 Claims, 11 Drawing Sheets

CAROUSEL DEVICES

This is a divisional application based on U.S. patent application Ser. No. 10/863,049 filed Jun. 7, 2004 now U.S. Pat. No. 6,869,368.

BACKGROUND AND SUMMARY OF THE INVENTION

The present invention relates to carousel devices. More particularly, the present invention is directed to oscillating and self-propelled amusement devices for toddlers and young children.

One of the joint inventors hereof has developed a series of patented carousel devices including the Baby Carousel (U.S. Pat. No. 5,487,705 and D362,346), improvements thereto entitled Carousel Device (U.S. Pat. No. 5,660,430), Carousel Pony (U.S. Pat. No. 5,935,010) and Low-Profile Infant Swing Assembly (U.S. Pat. No. 6,343,994), each of which is hereby incorporated by reference. While these patented devices are significant advances in the areas they address, several areas remain unaddressed.

First, bouncers for toddlers are routinely unimaginative; very little innovation has taken place in this area. In addition, the flimsy bouncers in use today, are at risk to tip over possibly injuring the baby. The present invention proposes to put a bouncer on the carousel base providing significant stability thereto. In addition, rockers are provided to the carousel base which may optionally afford the toddler additional movement, to enhance its enjoyment of the device. Lastly, an oscillation circuit is provided for the bouncer such that when the toddler wears her/himself out, the gentle oscillatory motion can induce sleep. Indeed, the oscillation circuit which has been developed for this application is so innovative, it is anticipated that it can be used in other applications, as well.

Second, all carousel devices heretofore have been powered by an electric motor. Statistics on even very young children show an alarming rate of obesity. With increased time spent viewing television, videos, computer screens, and reduced emphasis on physical education in the school system, many children fail to get adequate exercise for proper muscle development, let alone, for avoiding becoming overweight. The second embodiment of the carousel devices of the present invention provides a carousel riding toy which is self-driven, i.e., the motorcycle mounted on the rotational base of the carousel is equipped with pedals which provide the young child with exercise while she/he enjoys riding on the carousel cycle. As encouragement to continue pedaling, as long as the child pedals, a sound generator makes the sound of a revving motorcycle. While once the cycle is rotating on the stationary base, the child may choose to coast, the sound will abate. Another innovative feature of the present invention is the introduction of a ball-bearing race supporting the rotational base on the stationary base. This advancement provides much less resistance to rotation than the nylon wheels used in previous carousel embodiments, providing the young child more rotation for her/his expenditure of effort.

Various other features, advantages and characteristics of the present invention will become apparent to one of ordinary skill in the art after a reading of the following specification.

BRIEF DESCRIPTION OF THE DRAWINGS

The preferred embodiment(s) of the present invention is/are described in conjunction with the associated drawings in which like features are indicated with like reference numerals and in which.

DETAILED DESCRIPTION OF PREFERRED EMBODIMENT(S)

Figure 1:
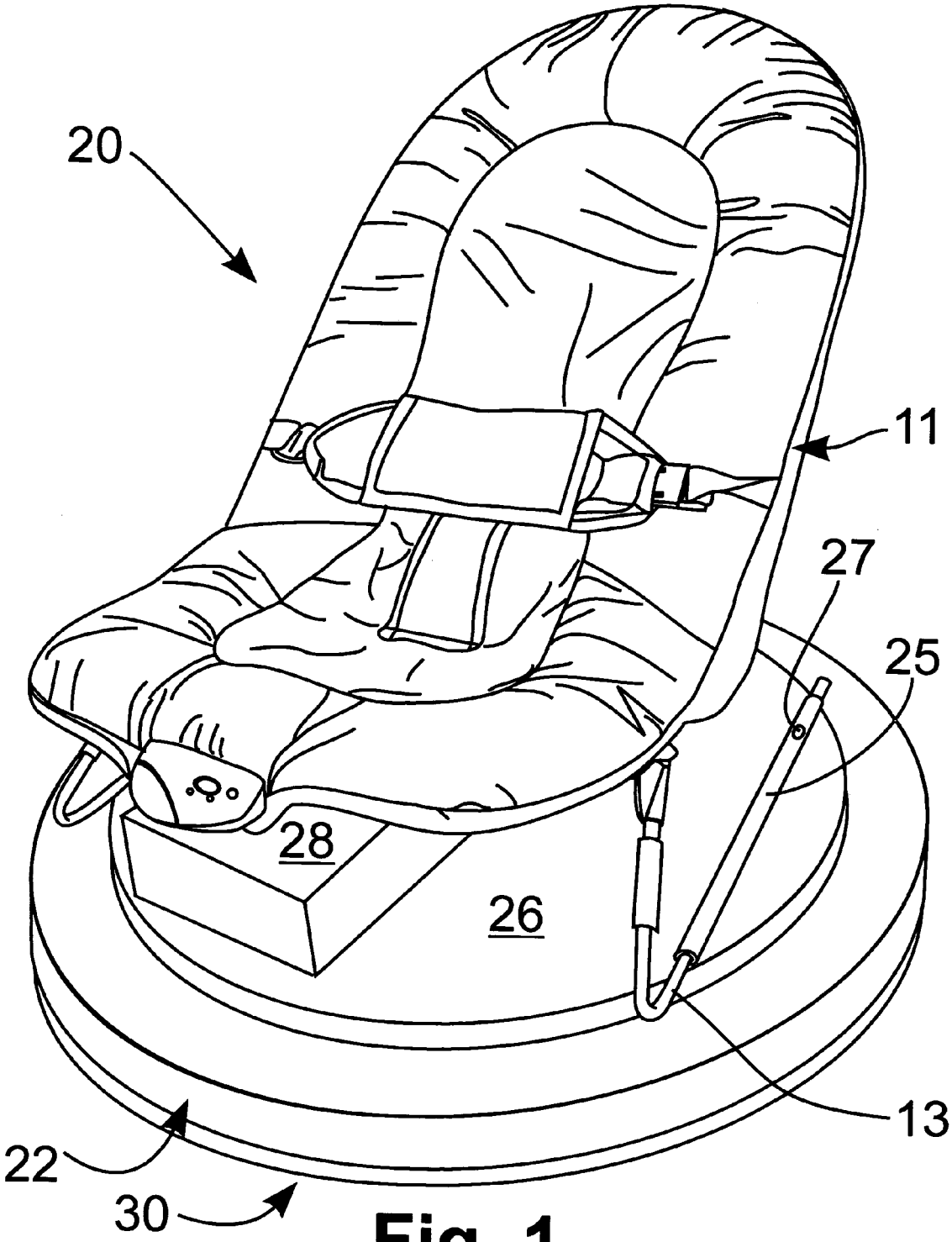
FIG. 1 is a perspective front view of a first embodiment of the carousel device of the present invention.
Figure 2:
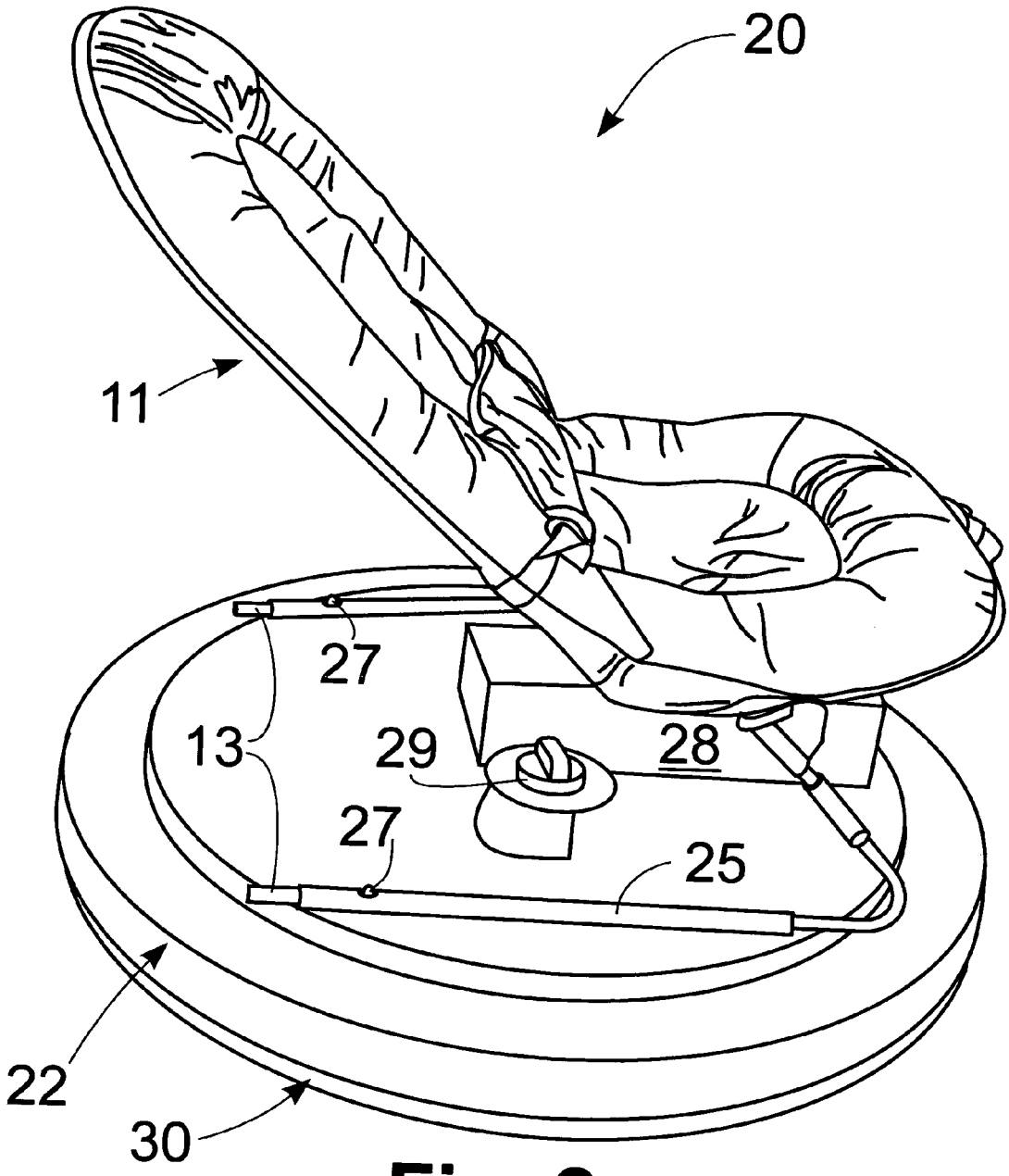
FIG. 2 is a perspective side view of a first embodiment of the carousel device of the present invention.
Figure 3:
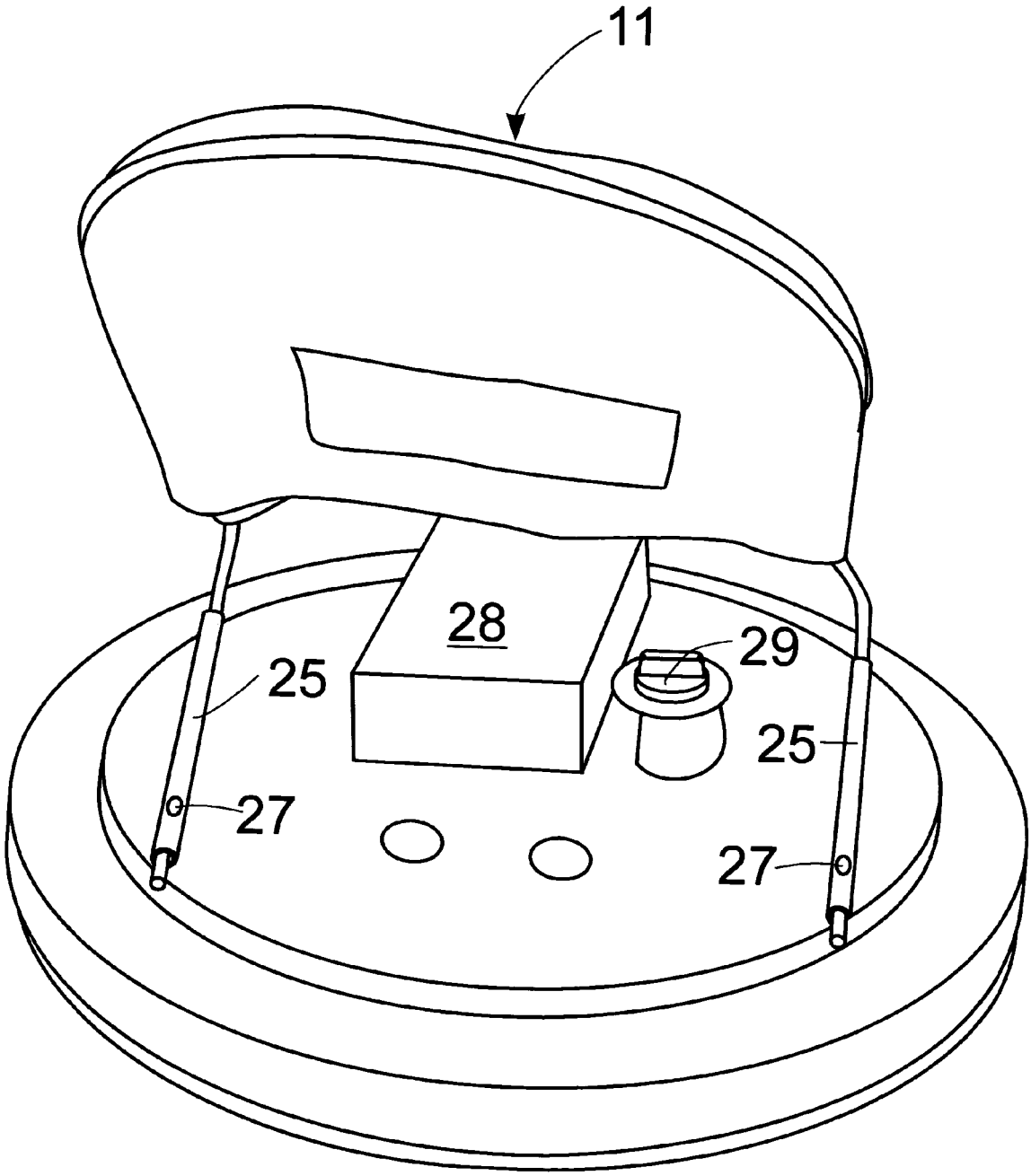
FIG. 3 is a perspective rear view of a first embodiment.
Figure 4:
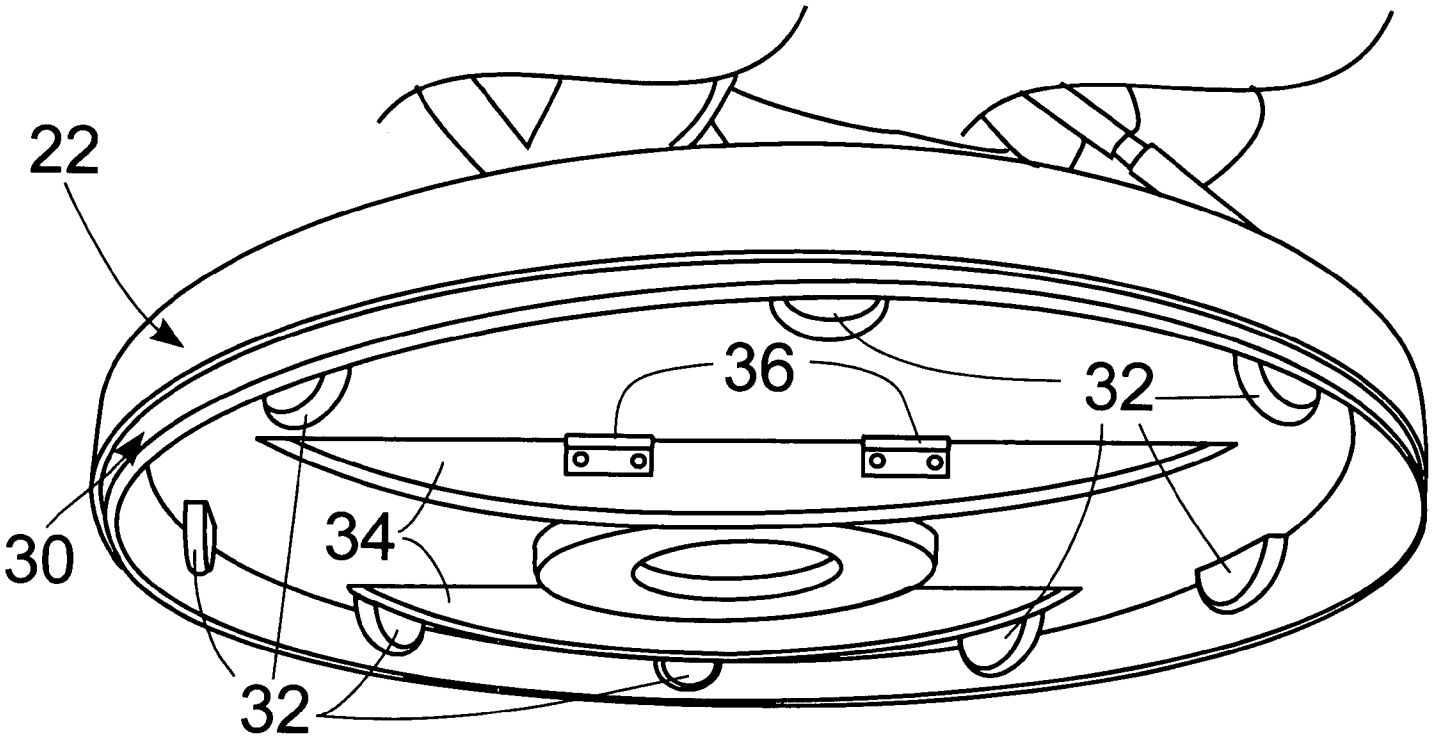
FIG. 4 is a partial perspective bottom view of the first embodiment.
Figure 5B:
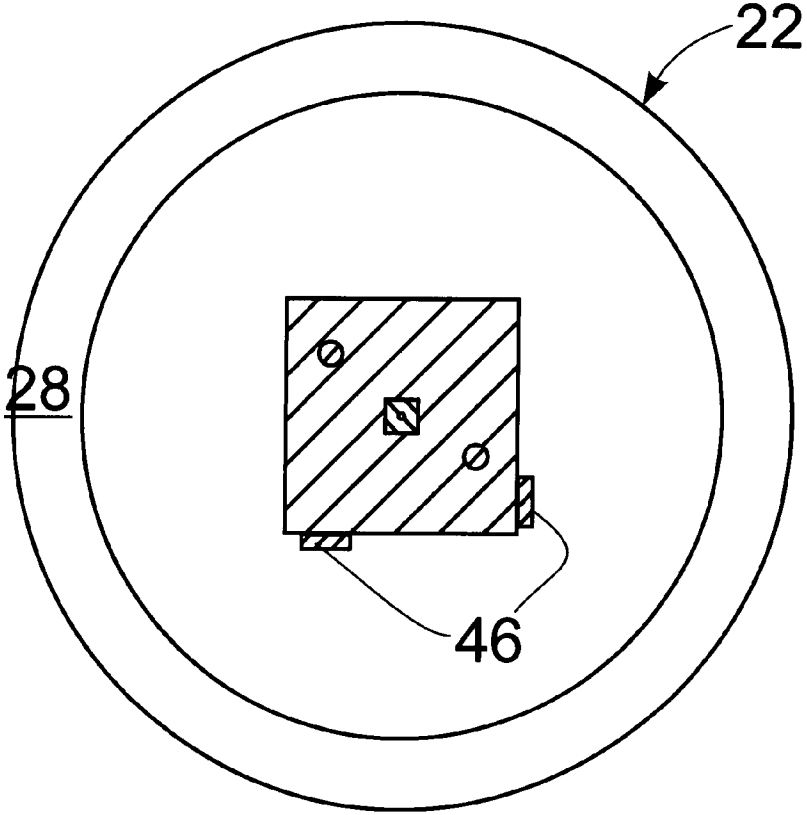
FIG. 5B is a bottom schematic view of the rotational base.
Figure 5A:
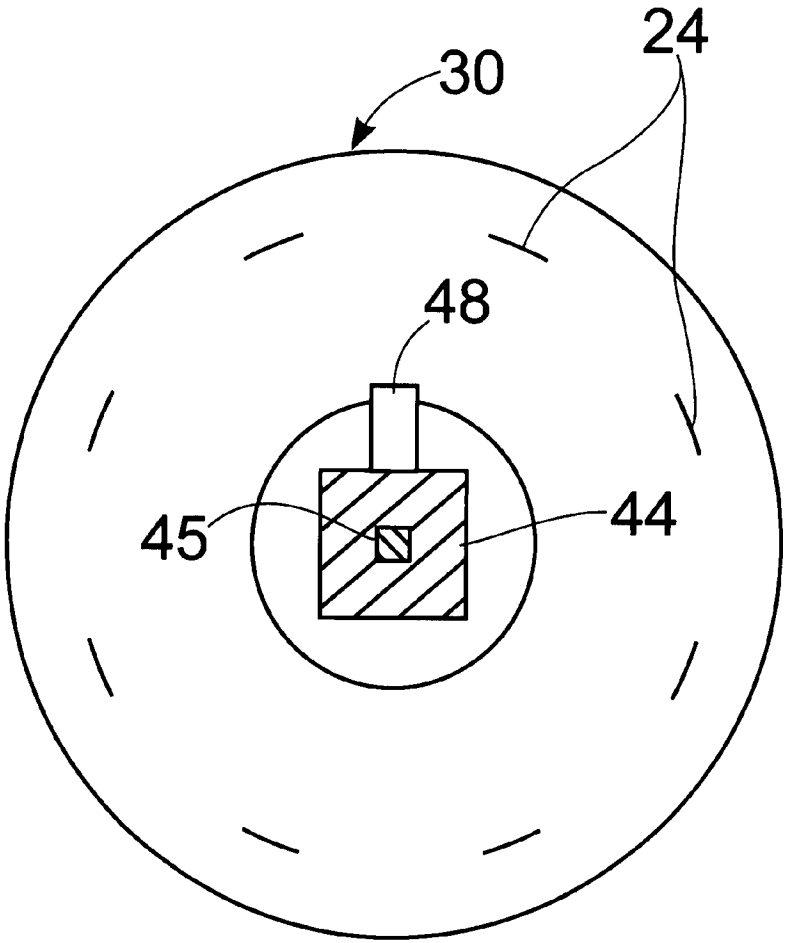
FIG. 5A is a top schematic view of the stationary base.
Figure 5C:
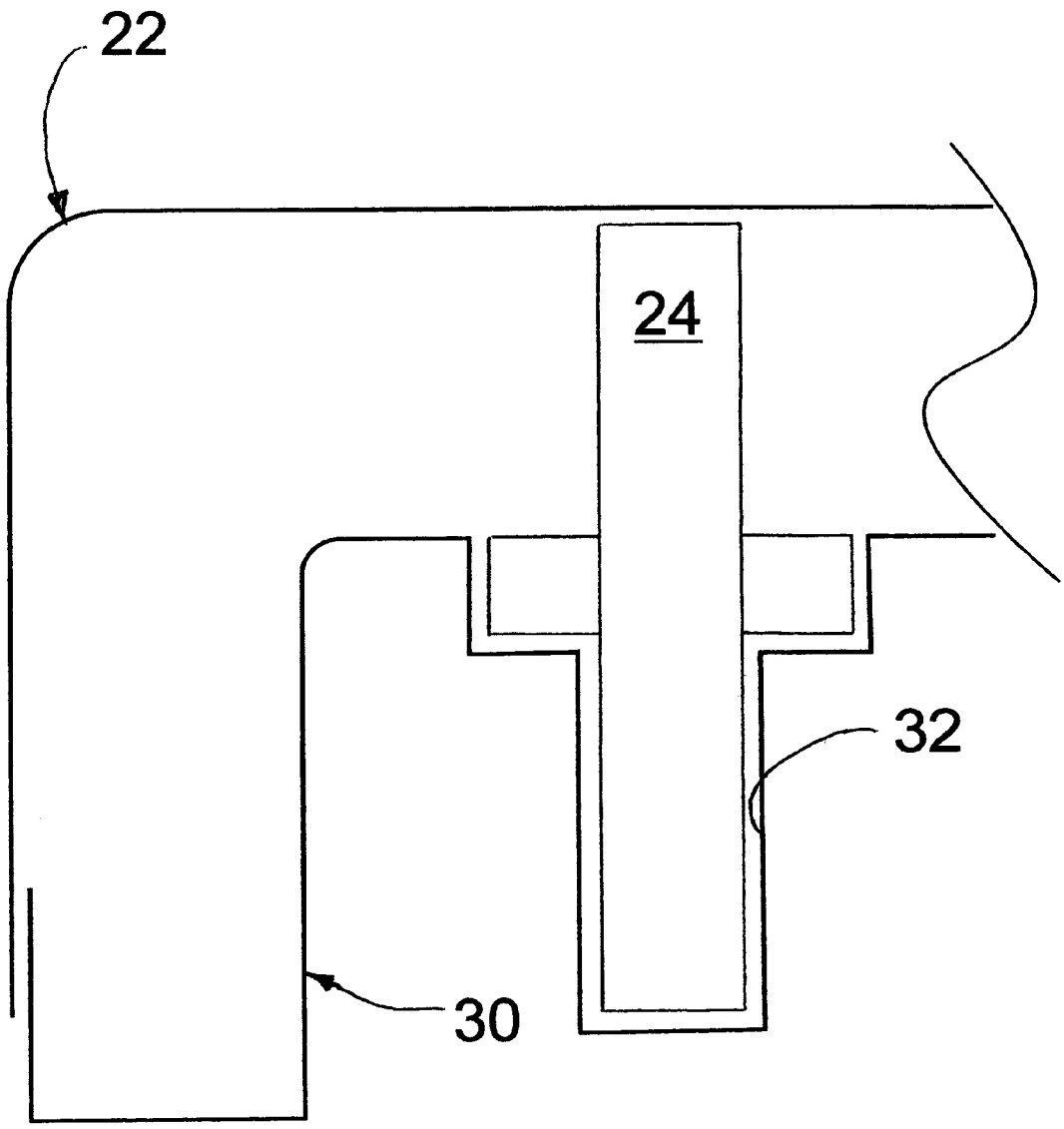
FIG. 5C is a partial cross-sectional view of the rotational base sitting atop the stationary base.

A first preferred embodiment of the carousel devices of the present invention is depicted in FIGS. 1–3 generally at 20. As in the other carousel devices, the present device 20 has a stationary base 30 upon which rotational base 22 rides supported on bearing means or wheels 24 situated in slots 32 in the stationary base 30 (FIG. 5C). A conventional bouncer 11 can be situated on rotational base 22 by inserting legs 13 in cylindrical receptacles 25 which are molded into upper surface 26 of rotational base 22. Receptacle 25 has a hole 27 near the rear thereof which will receive a spring-biased ball lock to retain bouncer 11 in position on rotational base 22 until it is desired to remove it for storage or transport. An external housing cover 28 is shown atop surface 26 enclosing the motor and the batteries which power it. It will be understood that more preferably, receptacles will be formed in the stationary base to receive the motor and batteries which will, then, be concealed by the rotational base 22. Switch 29 (FIG. 2) activates a circuit which plays music (e.g., a lullaby). This, too, will preferably be recessed into a molded cavity in rotational base 22.

Figure 6:
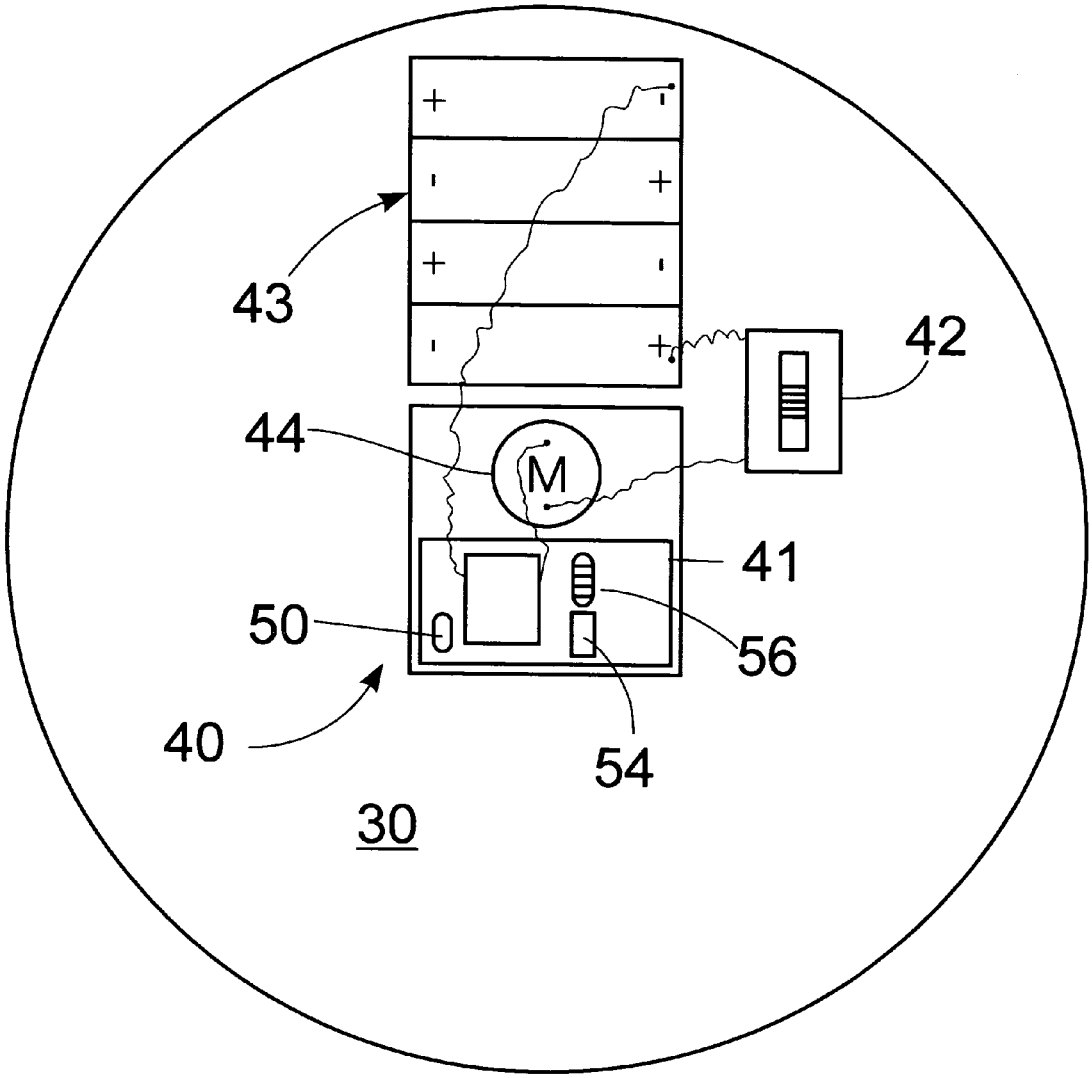
FIG. 6 is a schematic of the electrical circuit utilized in the first embodiment.

The first embodiment 20 of the carousel device of the present invention is provided with a novel oscillating circuit depicted in FIG. 6 generally at 40. The majority of the components of circuit 40 will be recessed in molded cavities in stationary base 30, the lone exception being switch 42 which will normally be positioned atop rotational base 22 for ease of access but which has been shown as adjacent motor 44 for ease of depiction. Switch 42 is a 3-position switch for activating motor 44. In the center position, the motor 44 is switched off. In a first upper (as shown in FIG. 6) position, the motor 44 is connected to the power source 43 shown here as four D size batteries and the rotational base 22 turns carousel device 20 through 360°. In a second lower position, switch 42 actuates magnetic switches 46 (FIG. 5B) shown attached to the nether side of rotational base 22. Magnet 48 (FIG. 5A) is attached to the exterior of motor 44 which is fixedly mounted to stationary base 30. As shaft 45 of motor 44 rotates rotational base 22 relative to stationary base 30, one of the switches 46 passes magnet 48. Switch 46 causes the current polarity to be reversed causing a reversal of the rotation of the motor 44 and, hence, of the direction of rotation of the rotational base 22. It should be noted that this oscillation occurs seamlessly: it is very gentle and without any type of jerking motion. With the position of switches 46 shown in FIG. 5B, the carousel device 20 oscillates through 80°. Obviously, different spacing of switches 46 would produce different angular oscillation. The remainder of the circuit 40 on circuit board 41 includes metal oxide varistor (mov) 50 to protect the circuit components from voltage spikes; relay 52 which functions as an electromagnetic switch; silicon controlled rectifier (SCR) 54 which serves as a latching switch; and resistor 56 which reduces the current coming from the battery to a level usable by motor 44. Resistor 56, SCR 54 and mov 50 are all rated for 100 million cycles. Relay 52 is rated for 10 million operations and magnetic switches 46 for 50 million operations.

Figure 7:
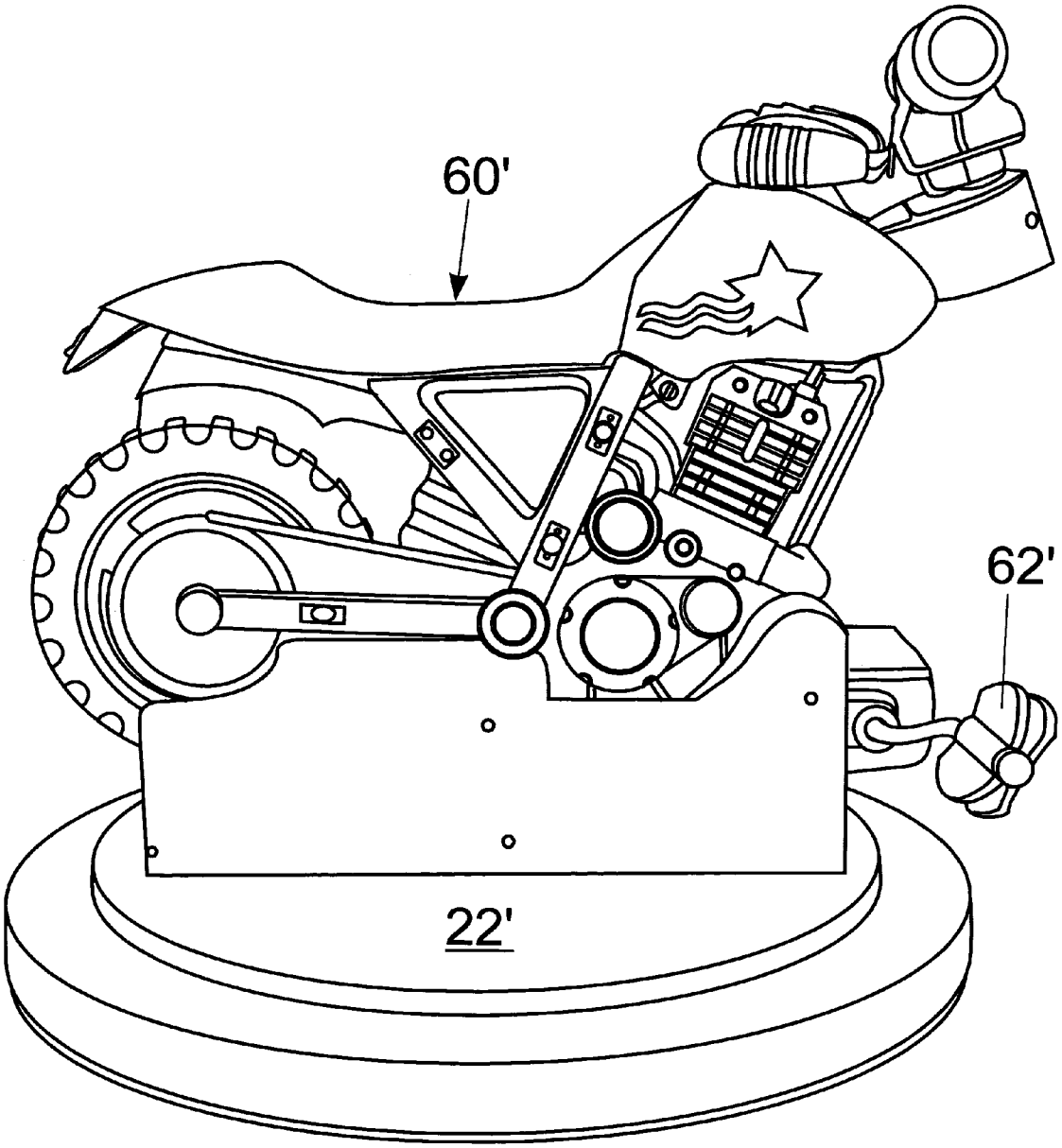
FIG. 7 is a perspective side view of a second embodiment of the carousel device of the present invention.
Figure 8:
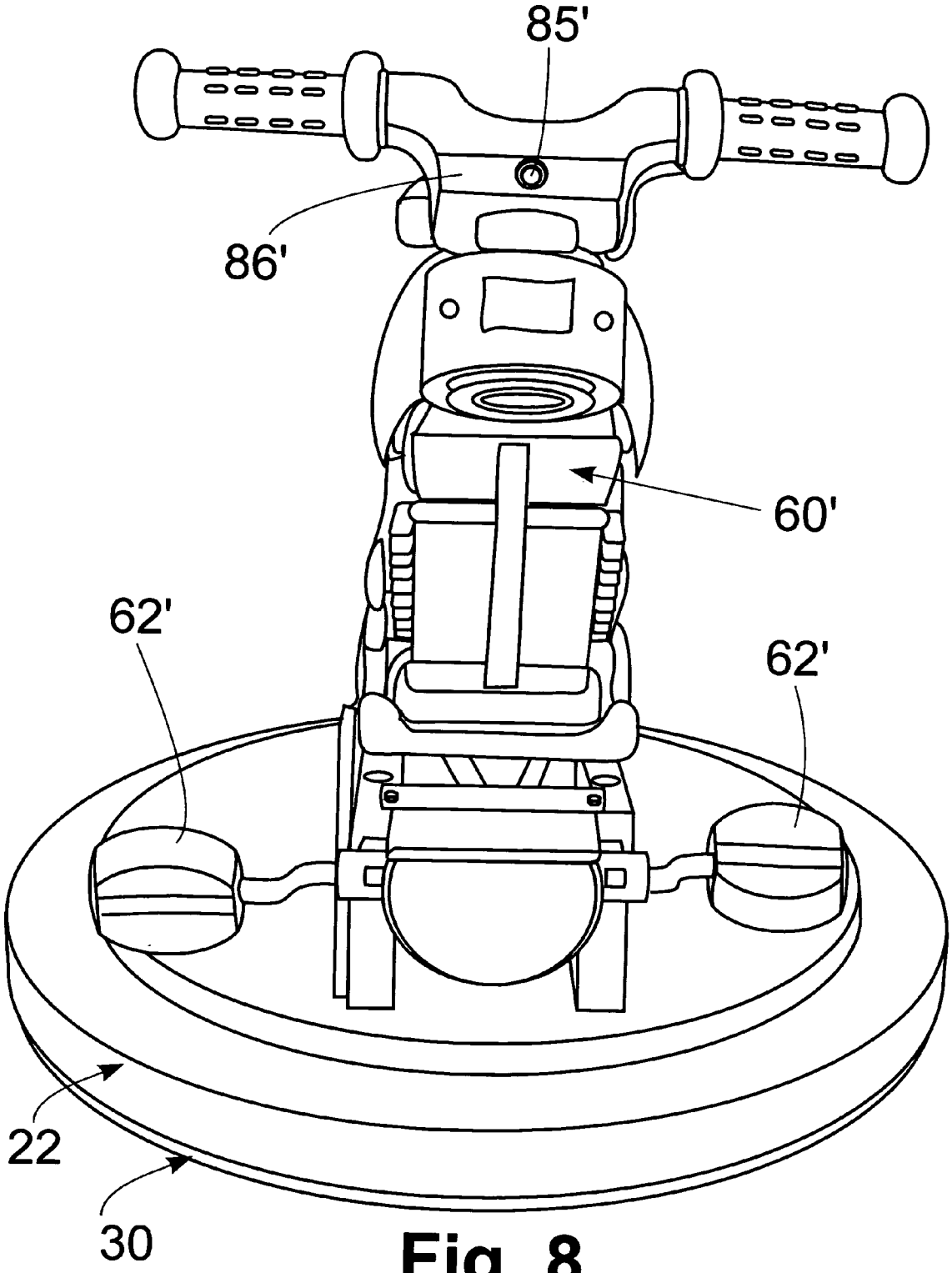
FIG. 8 is a perspective front view of the second embodiment.
Figure 9A:
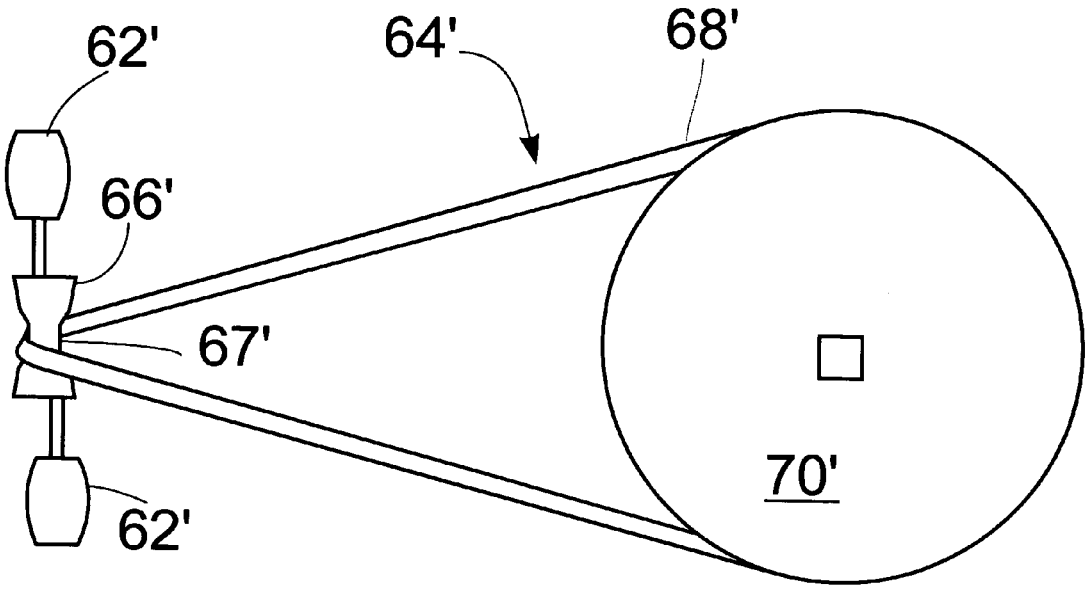
FIG. 9A is a schematic top view of a first drive system which may be employed with the second embodiment.
Figure 9B:
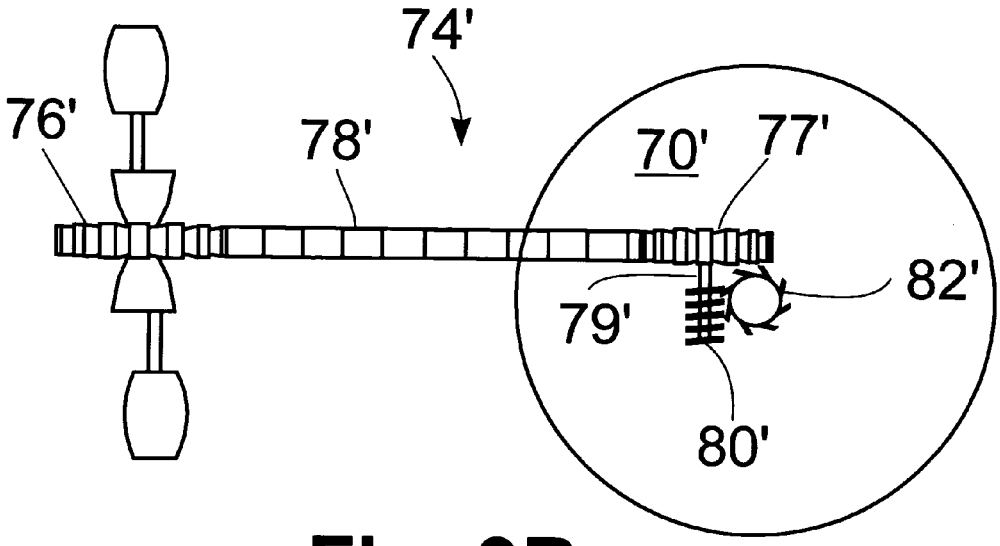
FIG. 9B is a schematic top view of a second drive system which may be employed with the second embodiment.

A second embodiment of the carousel device of the present invention is depicted in FIGS. 7 and 8 generally at 20'. In this embodiment a straddlable vehicle 60', shown here as a motorcycle, is fixedly mounted on rotational base 22'. Pedals 62' are provided to enable the youngster to provide her/his own motivation. As seen in FIGS. 9A and 9B, the pedals can be connected to the rotational base 22' through either a belt drive system 64' or a chain drive system 74'. The belt drive system includes a pulley 66' with a central V 67' to facilitate tracking of belt 68'. Belt 68' also is wrapped around driven means, a large diameter pulley 70', which is attached to the underside of rotational base 22'. Chain drive 74' includes a first gear 76' and a second gear 77' about which chain 78' travels. On shaft 79' which mounts gear 77', a spiral gear 80' is fixedly mounted and engages driven means, a second spiral gear 82', which is non-rotationally attached to a pulley 70" or may be directly attached to rotational base 22'. A push button 85' on the dash 86' of the motorcycle 60' activates a sound circuit which makes the sound of a revving motorcycle while the youngster rotates pedals 62' but the switch is opened when the pedaling stops. It anticipated that a clutch will be inserted in the drive train to permit coasting in a conventional manner utilized in bicycles. However, as noted, the child will be motivated to make the pedals 62' rotate (thereby getting additional exercise) in order to produce the motorcycle sound.

Figure 10:
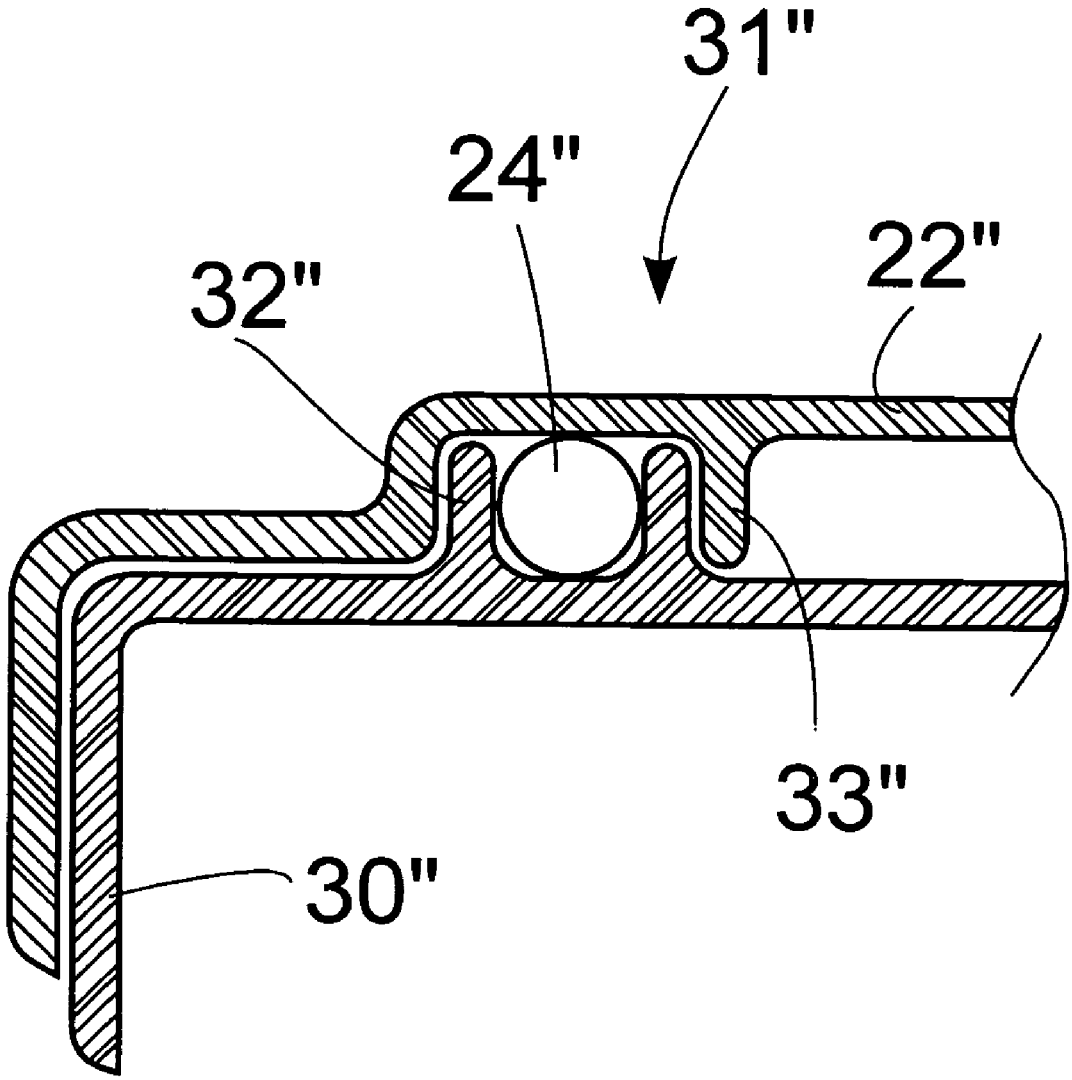
FIG. 10 is a partial cross-sectional side view showing a preferred rotational support system which may be used with either embodiment.

An alternative bearing means is depicted in FIG. 10 generally at 31". A bearing race 32" is molded in stationary base 30" with a complementarily shaped bearing race 33" formed in rotational base 22". A plurality of ball bearings 24" are positioned in bearing race 32" and rotationally support the rotary base 22" there above. Ball bearings 24" provide significantly less resistance than wheels 24 of the first embodiment enabling the youngster riding motorcycle 60' to produce greater rotation with less force. It is envisioned that ball bearings 24" may fill bearing race 32" or, alternatively, spacers can be inserted in race 32" so that five ball bearings 24" take the place of each of the 8 support wheels 24 of the first embodiment (FIG. 5A).

The first embodiment 20 of the carousel devices of the present invention provides a bouncer 11 which is provided with a rotational base that sits atop a stationary base 30. This configuration is extremely stable. A 200 pound man can stand on the edge of the rotational base 22 without causing it to tip. A unique electrical circuit 40 enables the carousel device 20 to rotate in a complete circle or to oscillate through an 80° arc, depending on the position of switch 42. The second embodiment 20' of the carousel device of the present invention enables a youngster to engage pedals 62', with either a belt drive 64' or a chain drive 74' converting the pedaling action into rotation of the rotational base 22'. The child will be encouraged to keep pedaling by a sound circuit activated by push button 85' and the rotation of pedals 62' to maximize the exercise that the child gets from playing with the carousel device 20'.

Various changes, alternatives and modifications will become apparent to one of ordinary skill in the art following a reading of the foregoing specification. For example, although the means for performing the oscillation of the first embodiment is preferred to be an electronic circuit, it will be appreciated a crank arm or other mechanical means, could be utilized instead without departing from the scope of the invention. Further, although the prototype shows wires interconnecting system components, in the production circuit board components will normally be soldered together. It is intended that any such changes, alternatives and modifications as fall within the scope of the appended claims be considered part of the present invention.

We claim:

1. A carousel device comprising a) a stationary base;

b) a rotational base;

c) bearing means positioned between and engaging both said stationary base and said rotational base enabling said rotational base to revolve about a central axis;

d) a straddlable vehicle having pedals mounted on said rotational base;

e) driven means non-rotatably attached to said rotational base;

f) drive means connected between said pedals and said driven means mounted on said rotational base;

whereby when a child climbs aboard said straddlable vehicle and begins peddling, said rotational base carrying said straddlable vehicle rotates relative to said stationary base.

2. The carousel device of claim 1 wherein said drive means comprises a chain connected to said driven means which takes the form of a gear attached to a spindle fixed to said rotational base.

3. The carousel device of claim 2 wherein said driven means further comprises a primary gear mounted on a first shaft which is engaged by said chain, a first worm gear fixed to said first shaft, said driven means including a second worm gear engaging said first worm gear, said second worm gear being mounted on said spindle fixed to said rotational base.

4. The carousel device of claim 1 wherein said drive means comprises a first pulley attached to a shaft to which said pedals are attached, a belt encircling said first pulley and a second pulley secured to said rotational base, said second pulley comprising said driven means.

5. The carousel device of claim 1 further comprising a sound circuit which provides a sound related to said straddlable vehicle as long as the child continues to pedal.

6. A carousel device comprising a) a stationary base;

b) a rotational base;

c) bearing means positioned between and engaging both said stationary base and said rotational base enabling said rotational base to revolve about a central axis;

d) a vehicle having pedals mounted on said rotational base;

e) driven means non-rotationally attached to said rotational base;

f) drive means connected between said pedals and said driven means mounted on said rotational base;

whereby when a child climbs aboard said vehicle and begins peddling, said rotational base carrying said vehicle rotates relative to said stationary base.

7. The carousel device of claim 6 wherein said drive means comprises a chain connected to said driven means which takes the form of a gear attached to a spindle fixed to said rotational base.

8. The carousel device of claim 7 wherein said driven means further comprises a primary gear mounted on a first shaft which is engaged by said chain, a first worm gear fixed to said first shaft, said driven means including a second worm gear engaging said first worm gear, said second worm gear being mounted on said spindle fixed to said rotational base.

9. The carousel device of claim 6 wherein said drive means comprises a first pulley attached to a shaft to which said pedals are attached, a belt encircling said first pulley, and said driven means including a second pulley secured to said rotational base.

10. The carousel device of claim 6 further comprising a sound circuit which provides a sound related to said vehicle as long as the child continues to pedal.

11. The carousel device of claim 6 wherein said vehicle is a single vehicle centered over said rotational base.

* * * * *